US008549978B2

(12) United States Patent
Chiappini et al.

(10) Patent No.: US 8,549,978 B2
(45) Date of Patent: Oct. 8, 2013

(54) METHOD AND SYSTEM FOR LOADING AND UNLOADING CARTRIDGES INTO A MAGAZINE FOR FIREARMS

(75) Inventors: Andrea Chiappini, La Spezia (IT); Michele Schettini, La Spezia (IT)

(73) Assignee: OTO Melara S.p.A., La Spezia (IT)

( * ) Notice: Subject to any disclaimer, the term of this patent is extended or adjusted under 35 U.S.C. 154(b) by 67 days.

(21) Appl. No.: 13/094,567

(22) Filed: Apr. 26, 2011

(65) Prior Publication Data

US 2011/0258898 A1 Oct. 27, 2011

(30) Foreign Application Priority Data

Apr. 27, 2010 (IT) ..... TO2010A0352

(51) Int. Cl.
*F41A 9/00* (2006.01)

(52) U.S. Cl.
USPC ..... 89/33.02; 89/33.05; 89/1.805

(58) Field of Classification Search
USPC ..... 89/1.802, 1.805, 1.41, 33.01–33.05, 89/33.17, 45, 46, 47; 42/6, 2
See application file for complete search history.

(56) References Cited

U.S. PATENT DOCUMENTS

| | | | | | |
|---|---|---|---|---|---|
| 1,424,751 | A | * | 8/1922 | Bangerter | 89/126 |
| 2,389,162 | A | * | 11/1945 | McInnes, Jr. | 89/1.41 |
| 2,790,353 | A | * | 4/1957 | Bird | 89/1.704 |
| 2,933,981 | A | * | 4/1960 | Anderson et al. | 89/1.804 |
| 3,173,334 | A | * | 3/1965 | Landstrom | 89/1.802 |
| 3,249,011 | A | * | 5/1966 | Wermager et al. | 89/1.8 |
| 3,376,785 | A | * | 4/1968 | Tore | 89/46 |
| 3,625,107 | A | * | 12/1971 | Smith et al. | 9/1.8 |
| 3,688,637 | A | * | 9/1972 | Tan | 89/12 |
| 4,198,897 | A | * | 4/1980 | Lipp et al. | 89/13.05 |
| 4,457,209 | A | * | 7/1984 | Scheurich et al. | 89/45 |
| 4,640,182 | A | * | 2/1987 | DeHaven et al. | 89/47 |
| 4,671,164 | A | * | 6/1987 | DeHaven et al. | 89/34 |
| 4,777,863 | A | * | 10/1988 | De Haven et al. | 89/33.1 |
| 5,036,611 | A | * | 8/1991 | Schmid | 42/39.5 |
| 5,131,316 | A | * | 7/1992 | Lawrence et al. | 89/46 |
| 5,177,318 | A | * | 1/1993 | Martinez et al. | 89/46 |
| 5,341,721 | A | * | 8/1994 | Kotai et al. | 89/46 |
| 5,347,911 | A | * | 9/1994 | Hallqvist | 89/45 |
| 6,095,026 | A | * | 8/2000 | Poussard et al. | 89/46 |
| 6,345,562 | B1 | * | 2/2002 | Mannhart | 89/33.16 |
| 6,637,310 | B2 | * | 10/2003 | Borgwarth | 89/33.03 |
| 7,146,898 | B2 | * | 12/2006 | O'Dwyer | 89/12 |
| 7,311,032 | B2 | * | 12/2007 | Murello | 89/191.01 |
| 2003/0159574 | A1 | * | 8/2003 | Borgwarth | 89/33.03 |

FOREIGN PATENT DOCUMENTS

| | | |
|---|---|---|
| DE | 41 23 338 | 1/1993 |
| EP | 0 051 119 | 5/1982 |

* cited by examiner

*Primary Examiner* — Bret Hayes
*Assistant Examiner* — Joshua Freeman
(74) *Attorney, Agent, or Firm* — Merchant & Gould P.C.

(57) ABSTRACT

A firearm includes a breech or firing chamber 101 where the cartridge is made to explode, and a mouth portion 102 adapted to cause the cartridge to pass from the magazine to the breech. The magazine is engaged to the breech and includes a plurality of chambers 21 sequentially mobile with respect to breech 101 so as to present one after another in the loading position in which a charging mechanism 7 inserts the cartridge into breech 101. Each single chamber 21 can slide independently on at least one track 22 placed on the magazine longitudinally with respect to the axis X of breech 101.

8 Claims, 5 Drawing Sheets

METHOD AND SYSTEM FOR LOADING AND UNLOADING CARTRIDGES INTO A MAGAZINE FOR FIREARMS

This application claims benefit of Serial No. TO 2010 A 000352, filed 27 Apr. 2010 in Italy and which application is incorporated herein by reference. To the extent appropriate, a claim of priority is made to the above disclosed application.

BACKGROUND

The present invention relates to a method for loading and unloading cartridges inside the magazine of a firearm. Such magazine is for example of the cylinder type of a drum, to be applied on firearms placed either on military means, or on fixed positions.

Magazines are known, like the magazines of the Revolver guns, in which the cartridges are charged in a circular cylinder made by a plurality of chambers or seat where the cartridges are inserted.

In such technical solutions the cylinder, and in particular the various chambers, are fixed and the cartridge is triggered directly in the chamber, either making the function of the chamber coincide with that of the breech, or, through suitable systems and mechanisms, the cartridge is pushed by such chambers in a breech where it is subsequently triggered.

In the solution applied for the revolver guns, the rotation of the cylinder carries a new cartridge, at the mouth of the breech, ready for being deflagrated. This solution once applied to firearms like mortars, cannons and howitzers, which utilize cartridges with medium-large dimensions, requires to reinforce the aforementioned chambers, as the deflagrating power is great and it can damage both the chamber and the cylinder. In order to reinforce such chambers, it is necessary to realize a cylinder mechanism of great dimensions which occupies very large spaces.

However the direct deflagration in the chambers causes a great pressure loss by the deflagration, due to the presence of the gap in order to permit the rotation of the cylinder, so making less efficient the pushing on the bullet. Very great and heavy-duty cylinders are very heavy and require a greater effort for guaranteeing their rotation.

This solution is disadvantageous from an efficiency point of view and therefore it cannot be adopted on firearms of great dimensions.

A further technical solution known to a person skilled in the art consists in deflagrating the cartridge into a breech separated from the cylinder, by inserting a pushing mechanism of the cartridge from the chamber to the breech.

In said solution it is necessary that the cylinder be placed at a certain distance from the breech, for making space for a cradle so that in the recoil phase such cylinder is not damaged by the force unleashed by the deflagration. This distance involves the adoption of approaching systems of the cylinder or of the cradle, so that the actuator of the pushing mechanism can displace the cartridge contained in the chamber inside the breech, then moving away before the shot is deflagrated by the weapon.

An important problem is encountered in such solution after the deflagration, as it is necessary to free the breech from the shell in order to charge the next cartridge.

A known solution applied to light firearms like rifles or guns, plans to create vent chambers in which the gas generated in the breech by the deflagration is accumulated. Such gas is used for charging a spring mechanism which by means of an actuator pushes the cartridge out of the breech. But such solution is applied once terminated the recoil phase of the weapon. A further problem of the cylinder magazines of the known art is the extraction of the shells from the cylinder itself in order to permit the charging of new cartridges.

Such phase has the same problems seen in the aforementioned case for the charging of the cartridge inside the breech as it is necessary to provide for a mechanism which frees the chambers from the shells.

It is known that the firearms, mainly those of great dimensions, are equipped with a locking mechanism for the cartridges inside the chambers, in order to prevent them sticking out of their own chamber during the charging, the rotation or the positioning of the cannon with the raising required.

In order to free the cartridge a disengaging system of such locking mechanism is needed, which is disadvantageous in the known art in terms of execution time.

All these cited phases do not permit to have a very high firing rate, as such phases require a long and delicate procedure which cannot be excessively speeded up due to the use of mechanical systems. In firearms of great dimensions the firing rate is very important and such problem is not always of simple solution.

SUMMARY

The present invention aims to obviate such drawbacks by proposing a loading and unloading system and a loading and unloading method of the cartridges, adapted to optimize the time intervals, which introduces a pre-charging phase of the cartridge which anticipates the phase in which the cartridge is inserted in the breech. Such method furthermore permits the automatic execution of various phases at the same time, so increasing the firing rate.

The increase of the firing rate is possible thanks to an electronic control system which monitors and actuates the various mechanisms in a fast and safe way.

A peculiarity of such method is the mobility of the chambers of the cylinder compared to the cylinder itself, which remains in a fixed position with respect to the cradle; furthermore, the recoil is positively exploited to which the breech undergoes during the deflagration of the cartridge in order to catch and approach the suitable chamber to the cradle so speeding up the next charging phase.

In order to further speed up the process, the recoil force is also used for the extraction of the empty shell case from the breech, by exploiting the kinetic energy associated to the shell during recoil.

An aspect of the present invention relates to a loading and unloading system of cartridges and shells in a magazine for firearms.

A further aspect of the present invention relates to a loading and unloading method of cartridges and shells in a magazine for firearms.

BRIEF DESCRIPTION OF THE DRAWINGS

The characteristics and advantages of such system and such method will be better clear and obvious from the following description of an embodiment with reference to the annexed figures, which specifically illustrate.

DETAILED DESCRIPTION

Figure 1:
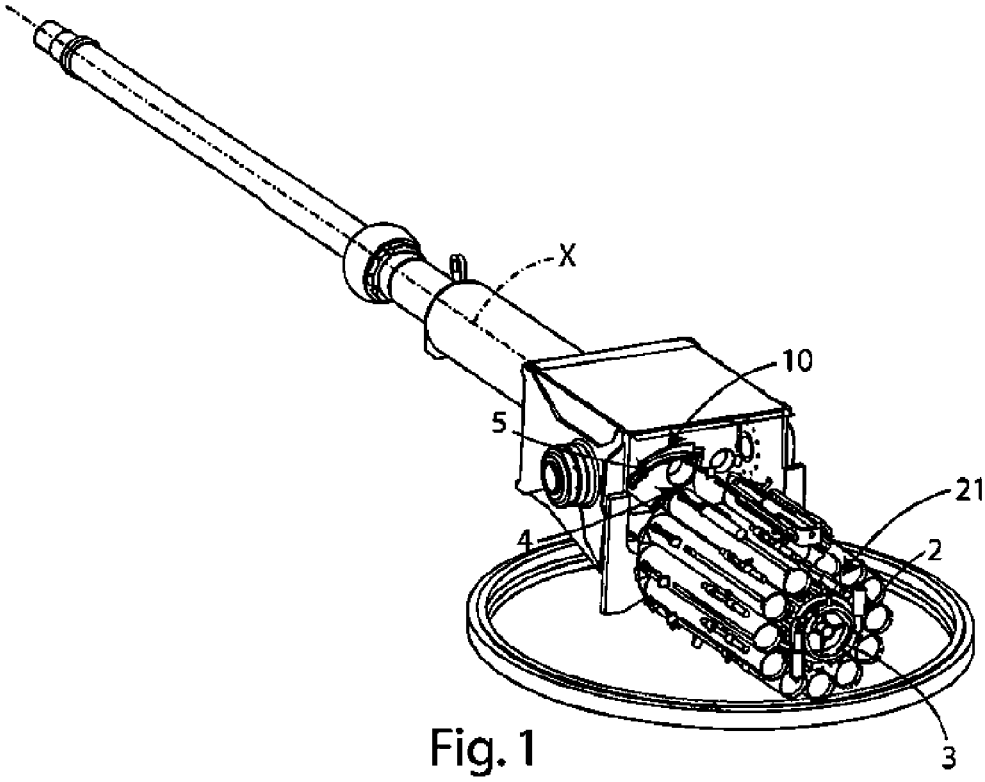
FIG. 1 the structure of the firearm in which the loading system according to the present invention is comprised.
Figure 2A:
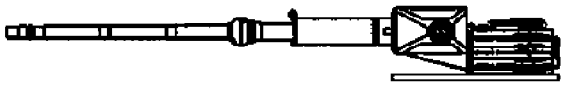
FIGS. 2A, 2B and 2C the firearm of FIG. 1 with various angles of elevation.
Figure 2B:
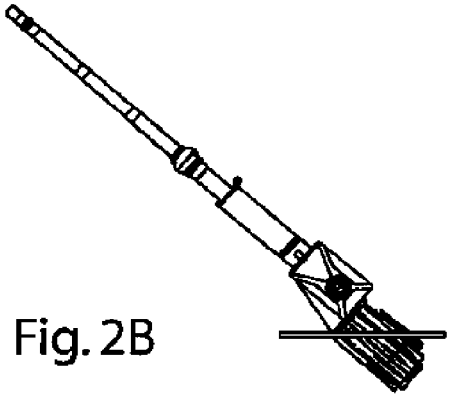
Figure 2C:
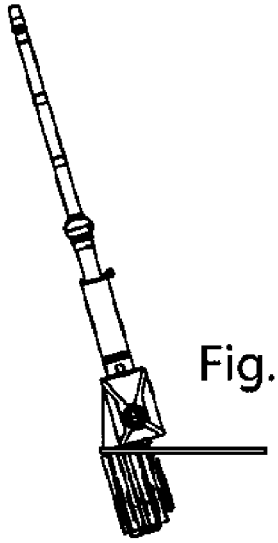
Figure 3B:
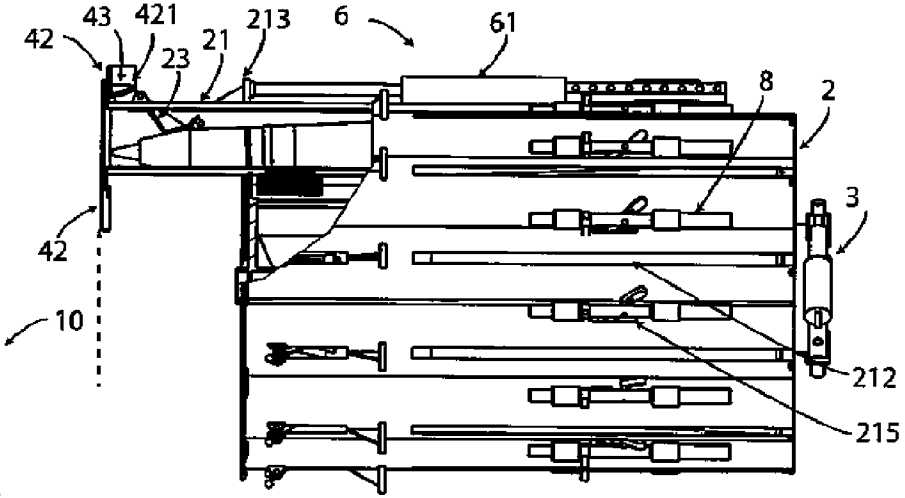
FIGS. 3A, 3B an enlargement of the loading system according to the present invention in the pre-charging phase in various angulations and FIG. 3C an enlargement of the catching mechanism of the chamber.
Figure 3C:
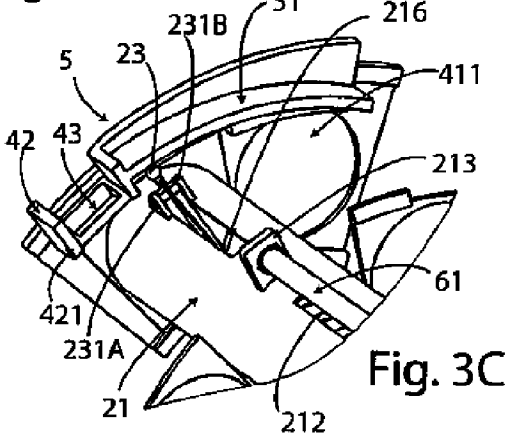
Figure 3A:
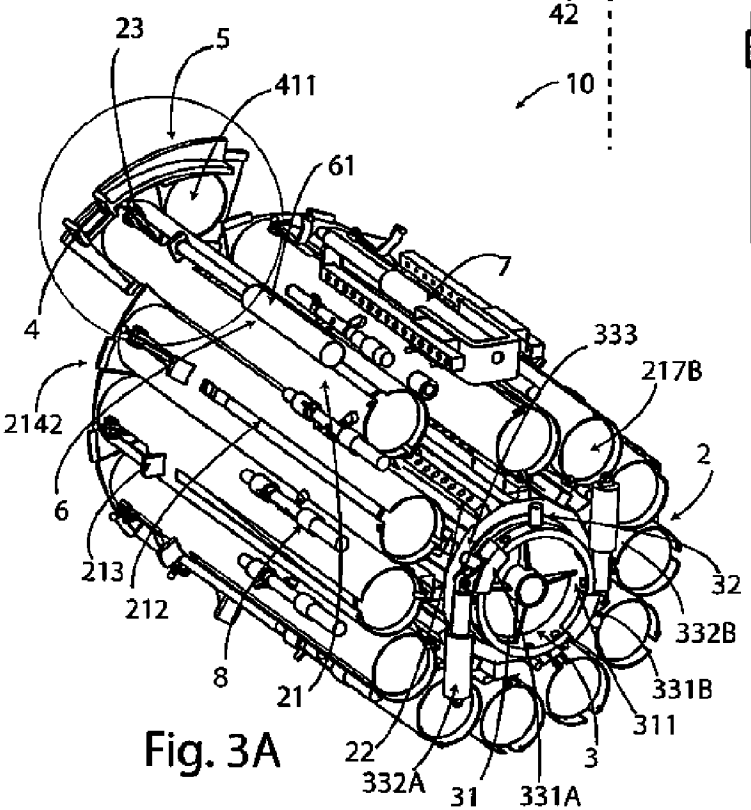
Figure 4:
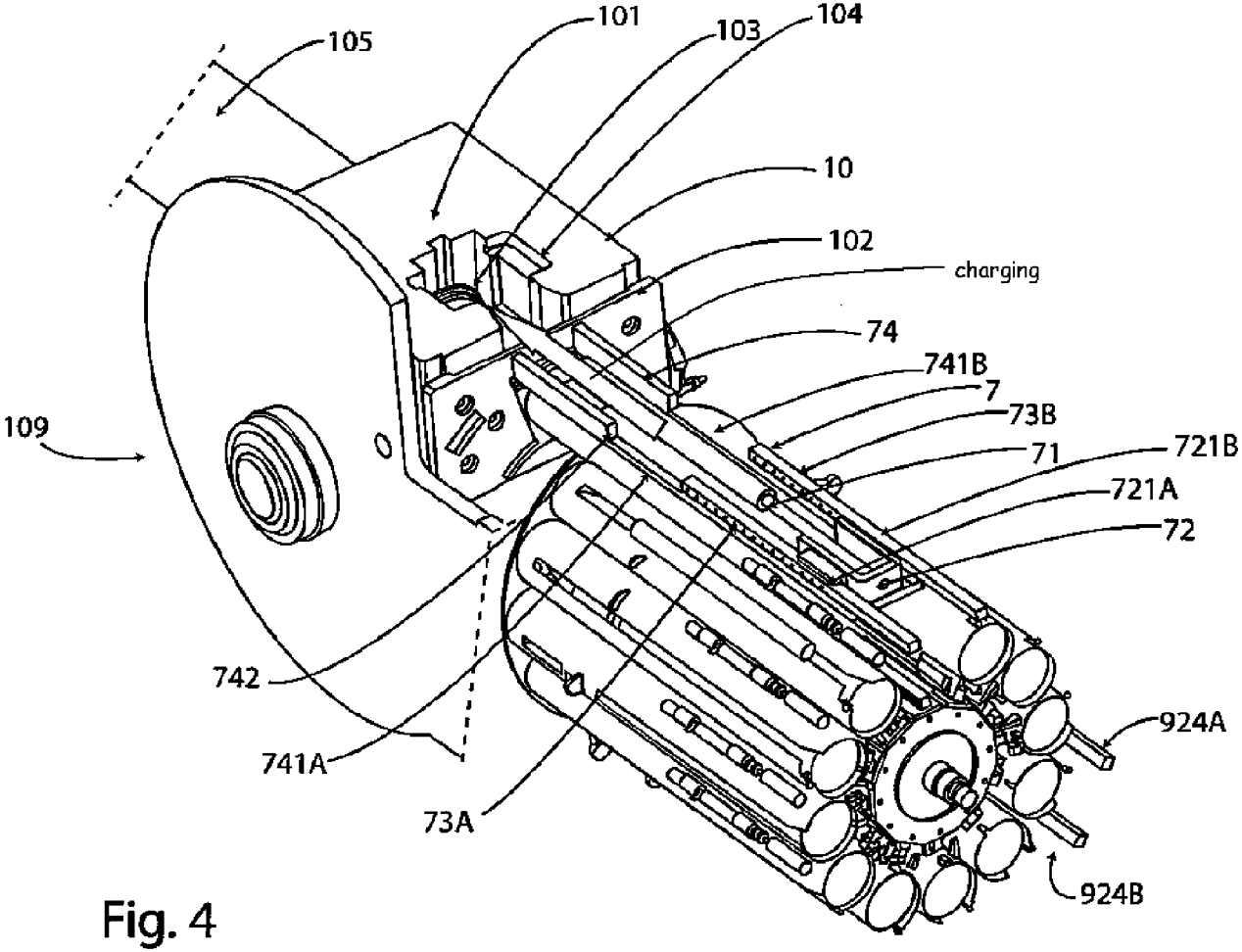
FIG. 4 the loading system in the loading phase of the cartridge.
Figure 5B:
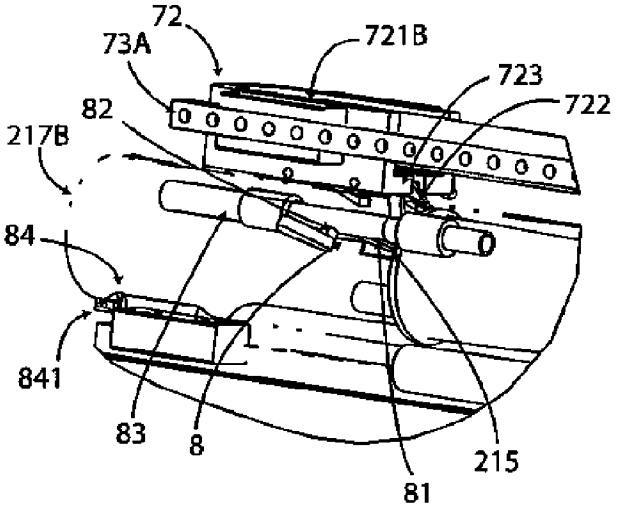
FIG. 5B an enlargement of a deceleration mechanism.
Figure 5A:
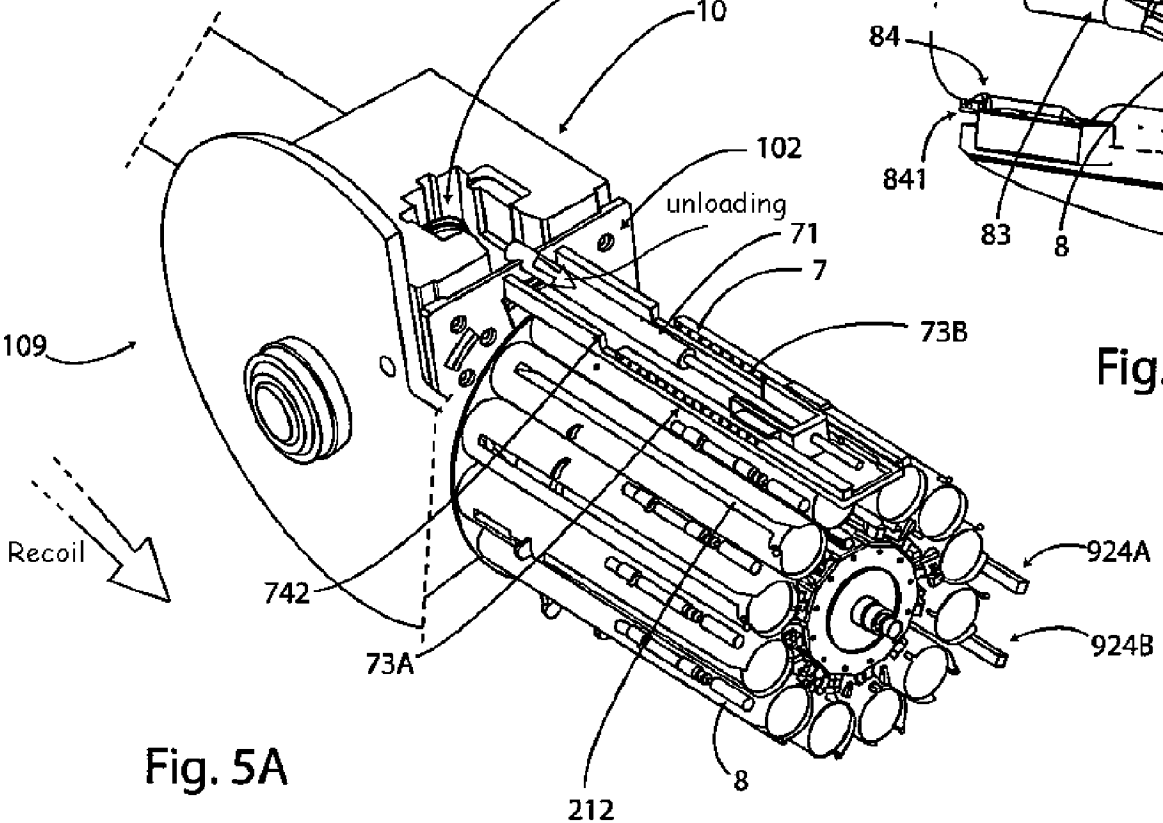
FIG. 5A the loading system in the recoil and extraction phase of the cartridge.
Figure 6:
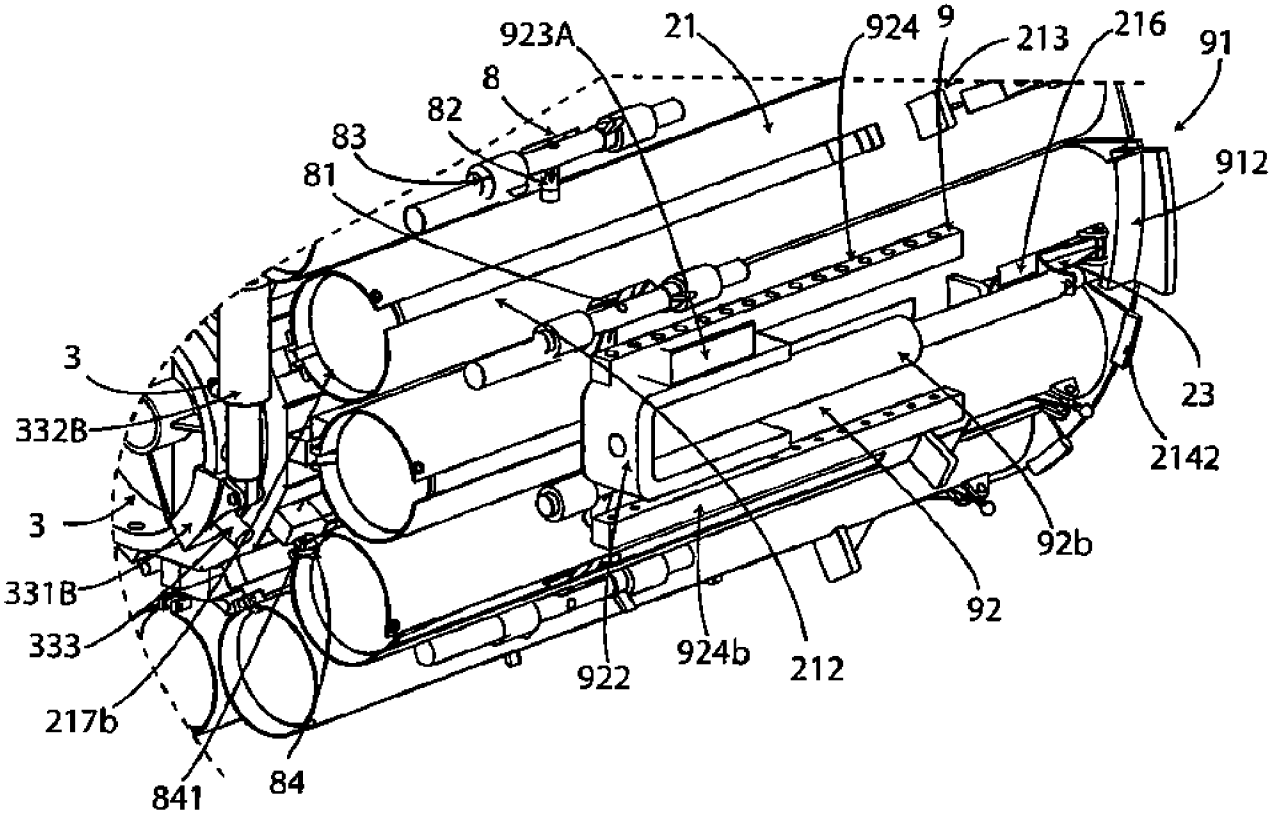
FIG. 6 the loading system in the extraction phase of the shell from the magazine.

With reference to cited figures the loading system according to the present invention comprises a box-like structure 109 inside which a plurality of chamber 21 are present, adapted to house the cartridges or shells, for example wrapped on a cylinder 2, a moving mechanism 3 of the chambers, a chamber catching mechanism 4 and a breech block 10, adapted to facilitate the loading of the cartridge. The system further comprises at least one cam mechanism 5 for disengaging a retaining lever 23 of the cartridge, a pre-loading mechanism 6 in order to permit the movement of chambers 21 towards breech block 10, a charging mechanism 7 for inserting the cartridge in a breech block 10, a deceleration mechanism 8 of the shell adapted to slow such shell once extracted from the fire chamber and an extraction mechanism 9 of the shell for freeing the chamber from the shell and permitting the insertion in cylinder magazine 2 of new cartridge.

The chambers are sequentially movable with respect to the breech, in order to present themselves one by one in the position in which charging mechanism 7 inserts the cartridge in the breech.

On cylinder 2 chambers 21 are placed, each chamber being movable and sliding, preferably on a rail 22, for example fixed to cylinder 2 itself, by a guide placed in the lower portion of such chamber 21. The movement of such chamber 21 is longitudinal with respect to the axis X of the breech.

The number of rails 22 and guides can increase in order to better assure the movement of chamber 21.

Such chambers 21 sliding on rails 22 and are equipped with a retaining device adapted to maintain chamber 21 always at the end of the stroke on cylinder 2.

Rail 22 is fastened preferably by bolts or equivalent systems, on cylinder 2 whereas the guides placed on chamber 21 can be directly integrated in the structure of chamber 21 or connected by means of welds or bolts or equivalent systems.

On such chambers 21, in the upper portion at least one retaining lever 23 of the cartridges is placed, suitably pivoted which rotates from the inside to the outside of the chamber and vice versa, thanks to at least one slot 216.

The pivoting of retaining lever 23 occurs at a pair of preferably triangular protrusions 231A and 231B, placed on chamber 21 between which said lever 23 is placed. Said protrusions 231A and 231B can be either directly created with the construction of chamber 21 or afterwards fixed with suitable fixing systems.

The shape of said protrusions 231A and 231B can vary in order to facilitate their fixing according to the chosen method.

At least one slot 215 is further present, placed on the side of chamber 21, where a portion of the deceleration mechanism 8 is placed.

In the proposed illustrative and not limitative solution twelve chambers 21 are present.

Position one defines chamber 21 being aligned with breech block 10, the numbering progressing in the clockwise direction up to position twelve.

Chamber 21 being in position twelve is the one interested to the preloading phase of the cartridge.

More generally, defining with n the number of chambers 21 of cylinder magazine 2, chamber 21 is at position one when it will be aligned with breech block 10, whereas cylinder 21 will be in position n when the preloading phase of the cartridge will be made.

Chambers 21 have preferably a cylindrical hollow shape, having a front mouth 217A towards breech block 10 and a rear one 217B towards the outside of the system. The dimensions of the chambers depend on the calibre of the cartridge which is used in such firearm. The material with which cylinder 2, chambers 21 and the above cited structures are made, is preferably metal but it is possible for example to create chambers 21 of different materials as for example of reinforced plastics or equivalent materials.

In the upper portion of each single chamber 21 at least one slot 212 is present, which covers at least one portion of said chamber 21 up to rear mouth 217B, adapted to permit to charging mechanism 7 to push the cartridge in block 10.

In line with said slot 212 an actuation plate 213 is present, made of metal or equivalent materials, suitably fixed to chamber 21, preferably by means of a welding or bolts or equivalent systems, which cooperates with pre-loading mechanism 6, in order to permits its function.

Said plate 213 in an embodiment can be directly realized together with chamber 21.

With every bed of the cylinder a hooking portion 2142 is associated, having a trapezoidal section adapted to engage with hooking mechanism 4, in order to bind the chamber itself to breech block 10. Cylinder 2 rotates around its own longitudinal axis, thanks to moving mechanism 3, comprising a wheel 31, connected with the central body of cylinder 2 by means of a pin 312, a locking peg 32 and a group of actuators 33 adapted to generate the rotation.

Said wheel 31 has a number of equally spaced holes 311, corresponding to the number of chambers 21 present on the cylinder 2.

Said holes 311 are penetrated by locking peg 32 which stops in this way the rotation of cylinder 2 in the various positions by assuring that it does not move from such seat during the recoil or other critical phases of the method.

Said peg 32 furthermore when suitably controlled raises coming out of hole 311, in which it was inserted, so permitting the rotation of the cylinder.

The rotation of cylinder 2 is generated by the group of actuators 33 preferably comprising at least two guide handles 331A and 331B substantially disposed on the circumference of the cylinder and which are bound to it by means of a pin 333. The handles then are respectively connected with at least two actuators 332A and 332B.

The number of handles and actuators can vary according to the dimensions of the cylinder and the safety level which such system can reach.

Actuators 332A and 332B are preferably realized with pistons or equivalent systems, they are vertically positioned in this embodiment and in opposition, in function of the rotation direction of cylinder 2. It is possible to vary the position of actuators 332 in function of the space available, in any case maintaining unchanged the functional principle.

During the movement of cylinder 2, peg 333 is inserted, by means of suitable control systems, in the suitable hole 311 in which the handle is positioned; thereafter actuators 332A and 332B stretch themselves in order to guarantee a couple of forces which, through handles 331A and 331B, gets the cylinder 2 to rotate.

In the phase in which cylinder 2 is stopped pegs 333 are disabled and extracted from holes 311 in which they were inserted; thereafter, actuators 332 are contracted so permitting their new extension in a subsequent rotation phase.

Breech block 10 comprises a breech or room of fire 101 where the cartridge is made explode, a portion of mouth 102, comprising a preferably metal structure with a through hole, a transit chamber 104 adapted to make the cartridge transit, a shutter 103 and a barrel 105. Said block 10 can move along the direction of breech 101 during the recoil caused by the deflagration of the cartridge.

During the charging the cartridge enters through the hole in mouth portion 102 and by the crossing of transit chamber 104 reaches breech 104; at this point shutter 103 is closed and the cartridge is ready to be deflagrated for shooting the bullet and make it exit from barrel 105.

Said aforementioned structures are preferably made of metal material or of equivalent material adapted to withstand the deflagration of the cartridge.

Said breech block 10 can vary in shape, dimensions and number of parts according to the firing device used, so that it must not be considered limitative.

Charging mechanism 7 is placed above chamber 21 being in the position one and is integrally associated with breech 101 and comprises a pushing actuator 71, for example a hydraulic piston interposed between the breech and a sled 72, for example realized with the shape of a U positioned over such chamber 21, adapted to move in the direction of the breech for a predetermined distance. Said sled moves on guides 721A and 721B, which slide on two tracks 73A and 73B.

Tracks 73A and 73B preferably have a rectangular cross-section with holes. Said tracks in turn slide on a U-shaped bar 74 connected with the base with the portion of mouth 102 of the breech block 10. Said bar 74 has a step 742 in both arms 741A and 741B at a distance equal to the recoil of breech block 10, so that tracks 73A and 73B can slide on the same in order that sled 72 moves for a predetermined distance so to permit the charging of the cartridge and the return of the shell after the shooting, as the aforementioned step has an end-of-stroke function for tracks 73A and 73B.

The shapes of tracks 73 and of arms 741 can vary from the one described, as their task is to assure the longitudinal movement of mechanism 7, for example by creating tracks 73 with a triangular shape and arms 741 with a shape complementary to that of tracks 73 for permitting and assuring the movement.

In the lower portion of said sled 72 at least one portion 722 of the push is present, adapted to push the cartridge placed in chamber 21 inside breech block 10 by virtue of the movement generated by such actuator. Said portion 722 of the push preferably has a triangular section as seen in projection. Portion 722 of the push slides inside slot 212 of chamber 21 by pressing on the bottom of the cartridge. Said portion 722 is geared to bar 72 through pin 723 which permits to pushing point 722 to rotate, as during the rotation of cylinder 2 such pushing points 722 must be raised so permitting the rotation, then being lowered just before charging mechanism 7 is actuated.

Pre-loading mechanism 6 comprises a pre-loading actuator 61 which, preferably acting on plate 213 placed on chamber 21, permits to the same to advance for a quantity sufficient to engage hooking mechanism 4, preferably during the recoil of block 10 thanks to hooking portion 2142. In particular, the advancing movement of the chamber in the pre-loading position occurs at the same time with the recoil movement of the breech block.

Actuator 61 is preferably provided with a piston placed on the position preceding the one in which the cartridge is inserted into the breech, in order to permit the rotation of cylinder 2.

Hooking mechanism 4 of the chamber comprises a shaped hooking plate 41 connected with mouth 102 of breech block 10.

Said plate 41 has the shape of a section of a crown of circumference comprising a through hole 411 adapted to make the cartridge transit from chamber 21 to breech 101 in the loading phase of the cartridge.

Said plate 41 can advantageously be directly integrated with breech block 10.

Hooking mechanism 4 also comprises a housing 42 for example U-shaped, placed on the edge of plate 41, in which a mobile hooking plate 43 is geared, preferably having an L-shaped cross-section, which can partially rotate around the axis of pins 421.

The disposition of portion 42 depends on the rotation of the cylinder which in the case described is of clockwise type.

Said mechanism 4 is actuated on chamber 21 being at position twelve, so in the position preceding the one in which the cartridge is inserted in the breech.

Plate 43 rotates by raising when the chamber approaches breech block 10, pushed by the actuator of the pre-loading mechanism, until hooking portion 2142 placed on chamber 21 overcomes such plate 43 which can again descend so blocking chamber 21 in a position proximate to mouth portion 102 of block 10.

This engagement is permitted by the synchronized recoil motion of block 10, following the deflagration, with that of chamber 21 thanks to pre-loading mechanism 6. It is possible to implement a control to pre-loading mechanism 6, so that it can engage chamber 21 at position twelve to hooking mechanism 4 without the occurrence of the recoil of breech block 10, for example in order to pre-load the first cartridge in the shooting session in which no cartridge is yet present inside breech 101.

During the rotation in order to move from the pre-loading position (twelve) to the one of insertion of the cartridge in the breech (one), cam mechanism 5 is activated comprising a cam 51, formed by a circular portion 511 with a reduced curvature angle with respect to that of shaped plate 41, and at least one guide placed externally with respect to circular portion 511 in which hooking portion 2142 is inserted, which in this way is not subject to the movement of the cam, so always guaranteeing the engagement of chamber 21 itself with breech block 10.

Said cam 51 is adapted to disengage from the retaining lever of cartridge 23.

Said cam 51 during the rotation of cylinder 2 raises lever 23, by making it come out of the profile of chamber 21 by means of provided slot 216.

In fact, according to a characteristic of the present invention, during the rotation between the pre-loading position and the loading position the cartridge is freed by means of the disengaging of the retaining lever from cartridges 23.

Cam 51 can be realized in various shapes adapted to guarantee the raising of lever 23 during the rotation of cylinder 2.

By raising said lever 23 it is possible to push the cartridge thanks to charging mechanism 7 inside breech block 10.

The guide can be realized by bending the edges of plate 41 in order to generate a ditch able to make hooking portion 2142 slide without generating clearances among the parts and to avoid the release of chamber 21 during the recoil, which chamber 21 thanks to track 22 slides following the movement of breech block 10.

Once having deflagrated the shot, block 10 recoils, and such force as well as contribute to the hooking of chamber 21, at position twelve, as seen before, is used for the extraction of the shell from breech 101. In fact, once having reached a certain predetermined recoil distance by breech block 10, shutter 103 is opened so permitting the automatic exit of the shell from breech 101, as the same shell has a kinetic energy generated by the recoil force.

The shell when exiting from breech 101 is guided by means of transit chamber 104 towards the empty chamber 21 being at position one.

Such acceleration is dampened by deceleration mechanism 8 placed on every chamber 21.

Said deceleration mechanism 8 is adapted to slow the speed of the shell and avoid that it can damage portions of the structure of the magazine, and comprises a contact portion 81, a device with levers 82, a dampener 83 and a block portion 84.

The shell entering chamber 21 after the deflagration hits contact portion 81, which by means of the device with levers 82 slows down the movement of the shells thanks to dampener 83.

The shell is definitely blocked in its progression from block portion 84, placed in the end portion of chamber 21.

Said portion 84, having a preferably triangular shape seen in projection, is fixed by means of pin 841 to the structure of chamber 21 and through suitable spring devices and is adapted to permit the introduction of new cartridges inside the empty chambers 21 being able to lower itself by rotating, but it does not permit the exit of the cartridge or shell from rear mouth 217B of chamber 21 thanks to a step.

In the embodiment proposed dampener 83 is a piston placed on the external surface of chamber 21, whereas contact portion 81 is placed inside chamber 21.

The motion of contact portion 81 is transmitted from the device with levers 82 placed in slot 215 to dampener 83.

Chamber 21 in a loading and unloading position of the shell, once having received the shell, is still engaged to breech block 10; in the subsequent rotation which brings it to position two, it is pushed in the subsequent chamber 21 which in turn moves from position twelve to position one.

Said rotation makes hooking portion 2142 of chamber 21 coming out of the guides, so being released; thanks to the retaining device of chamber 21 it comes back an the end of the stroke on cylinder 2.

The shell remains inside chamber 21 preferably until said chamber 21 goes over to position 4 from position three.

In said transit the expulsion mechanism of shell 9 is actuated.

Such mechanism comprises an expulsion plate 91 and a pushing device 92. Plate 91 comprises a through hole, adapted to transit the shell and a least one cam 912, adapted to raise the locking lever of cartridges 23 during the rotation in which chamber 21 moves from position three to position four.

The disengaging of lever 23 permits the subsequent expulsion phase of the shell by pushing device 92.

Said pushing device 92 is implemented in the same way with which charging mechanism 7 described before has been realized.

Said device 92 comprises an actuator which is fixed to a U-shaped structure 922 on which guides 923A and 923B are placed, which slide along two tracks 924A and 924B. Tracks 924A and 924B have a rectangular cross-section and are provided with holes.

In the lower portion of such structure 922 at least one pushing point is present (non shown in the figure), adapted to push the shell placed in chamber 21 at the outside of the cylinder structure 2, like it occurs for loading the cartridge in the breech.

The movement of such structure 922 is made by actuator 925 which is implemented with a piston. During the rotation such pushing points are raised so permitting the rotation of cylinder 2 and thereafter they are lowered just before the expulsion mechanism of the shell 9 is actuated.

Said mechanism 9 is placed at such a height from cylinder 2 to permit the rotation but also to permit to the pushing points to move the shell outside of chamber 21.

Said pushing device 92 is sustained by a U-shaped bar (not shown in the figure) fixed at the base to external structure 109. On the arms of the U-shaped bar tracks 924A and 924B of such system slide.

It is possible to choose to implement device 92 in a different way with respect to charging mechanism 7. Once having described in detail the single mechanisms making the system, the phases of the novel procedure of such invention will be described and specified.

Each phase will be distinguished by a general characteristic but all the secondary phases will be clearly specified, which are performed at the same time.

The method comprises the following phases: insertion of cartridges in the suitable chambers 21 of the cylinder magazine 2; pre-loading of the cartridge contained in chamber 21 placed at position n; rotation of cylinder 2; loading of the cartridge in breech 101; extraction of the shell from breech 101; displacement of chamber 21; unloading of the shell from the magazine; new loading of the chambers with new cartridges.

When analyzing more specifically the phase of insertion of cartridges in the suitable chambers 21 of cylinder magazine 2, it consists in loading with suitable systems all n chambers 21 forming cylinder 2.

The loading of such empty chambers 21 occurs by inserting the cartridge in mouth 217B where the portion of block 82 is positioned, which during the pushing of the cartridge is lowered and permits the entry of the cartridge in the chamber.

The insertion of the cartridges inside chambers 21 can occur in a sequential way for example by inserting the cartridges in the various chambers 21 being for example at position five, or at the same time in a predetermined number of chambers at the same time.

The pre-loading phase of the cartridges contained in chamber 21 placed at position n consists in hooking to breech block 10 of chamber 21, in a movable way through hooking mechanism 4 thanks to the combined action of the recoil of breech block 10 and of pre-loading mechanism 6.

In such a way, only chamber 21 placed at the position n Preceding the loading position of the cartridge in the breech is approached to breech block 10.

It is envisaged that the push of chamber 21 towards breech block 10 occurs only thanks to actuator 61 of pre-loading mechanism 6, for example in the first pre-loading phase when no cartridge is still present to deflagrate in breech 101.

The rotation of cylinder 2 thanks to rotation mechanism 3, occurs step-by-step, bringing chamber 21 from the position n to position one. Such motion disengages the retained lever of cartridge 23 thanks to cam mechanism 5, keeping the chamber 21 blocked near breech block 10. In the loading phase in breech 101, such cartridge being in chamber 21 having reached position one, placed near block 10, through charging mechanism 7, is inserted inside breech block 10.

At this point the cartridge is ready for being deflagrated.

Once having deflagrated the shot, after the suitable consent signals, the extraction phase of the shell from breech 101 is entered. Such phase consists in the extraction of the shell from mouth 102 during the recoil of breech block 10.

Once having reached a predetermined recoil distance, the shutter is opened and the shell with a certain kinetic energy during the maximum recoil comes out the breech and enters again in chamber 21 of position one remained empty, as such chamber is still hooked to breech block 10.

Chamber 21 during the recoil follows the motion of the breech block, thanks to track 22.

Such kinetic energy of the shell is dampened by a deceleration mechanism 8 placed in chambers 21 able to slow down such shell at the entry in the chamber.

The following phase is the unloading of the shell from the magazine. Such phase begins in chamber 21 to the inside of which a shell preferably reaches position three. In such position an expulsion mechanism is present which disables retaining lever 23 during the rotation from phase three to four, thanks to a cam 912 and finally when chamber 21 has reached position four an actuator 921 is activated, which pushes out the shell passing through the holed plate and recovered by a displacement system of the shell.

Once having the chamber reached position 5, it becomes free and here the last re-loading phase of the chambers is entered with new cartridges, which can be performed with the same mechanism of insertion of the cartridges which was seen in the first phase of the method described.

The passage of chamber 21 from one position, through rotation of cylinder 2 thanks to a rotary mechanism 3, to the other one occurs subsequently after the deflagration of a cartridge by making a step at the time.

The pitch of the cylinder is managed thanks to an electronic controller which governs rotary mechanism 3 on the base of signals coming from other mechanisms at play.

Another controller is present, also electronic which acts on the possibility of the cannon to shoot the cartridge which also receives signals from the other mechanisms cited before.

The method and the various mechanisms associated which were described in their preferred embodiment are applied to a cannon placed on military means. Nothing prevents that such system be also applied to cannons, mortar howitzers etc., fixed either on walls or in military strategic positions or on military ships.

Such integrated mechanism in a suitable tracking system can follow the firearm during the movements for the tracking, so permitting to reach elevation angles from 0° to 75° in the described embodiment.

But it is possible to extend such angle subtended with suitable modifications to the structure and the external housing of the tracking system applied to the firearm.

It is possible to apply such method and the mechanisms described before, even to a non-cylinder magazine; for example, they can be applied on a belt magazine in which chambers are always present, adapted to house the cartridges which can slide coming out of the edges of the conveyor belt along their longitudinal axis, so being able to perform the pre-loading phase of the cartridges increasing the firing rate.

The invention claimed is:

1. System for loading and unloading cartridges into/from a magazine for firearms, said firearm comprising a breech or firing chamber wherein the cartridge is made to explode, and a mouth portion adapted to cause the cartridge to pass from the magazine into the breech;

said magazine being engaged to said breech and comprising a plurality of chambers sequentially mobile with respect to the breech so as to present one after another in a loading position in which a charging mechanism inserts the cartridge into the breech;

wherein each chamber slides independently on at least one rail set on the magazine longitudinally with respect to a longitudinal axis of the breech;

wherein the chamber in a preloading position is constrained to the mouth portion of the breech by at least one engagement mechanism; and wherein, during passage between the preloading position and the loading position, the cartridge is released via disengagement of a lever for withholding the cartridge.

2. System according to claim 1, wherein the magazine is a cylindrical magazine, and the chambers are arranged thereon.

3. System according to claim 1, further comprising at least one preloading mechanism for enabling movement of the chambers of the magazine to a breech block.

4. System according to claim 3, wherein the preloading mechanism is associated with the chamber in a preloading position, which is a position preceding the loading position.

5. System according to claim 4, wherein movement of said chamber towards the preloading position occurs simultaneously with movement of recoil of the breech block.

6. System for loading and unloading cartridges into/from a magazine for firearms, said firearm comprising a breech or firing chamber wherein the cartridge is made to explode, and a mouth portion adapted to cause the cartridge to pass from the magazine into the breech;

said magazine being engaged to said breech and comprising a plurality of chambers sequentially mobile with respect to the breech so as to present one after another in a loading position in which a charging mechanism inserts the cartridge into the breech;

wherein each chamber slides independently on at least one rail set on the magazine longitudinally with respect to a longitudinal axis of the breech;

wherein, during movement for passing from a preloading position to a position of insertion of the cartridge in the breech, a cam mechanism is activated, the cam mechanism comprising a cam and at least one guide set outside with respect to the cam, in which an engagement portion of the chamber inserts, to guarantee at all times engagement of the chamber to a breech block during said movement.

7. System for loading and unloading cartridges into/from a magazine for firearms, said firearm comprising a breech or firing chamber wherein the cartridge is made to explode, and a mouth portion adapted to cause the cartridge to pass from the magazine into the breech;

said magazine being engaged to said breech and comprising a plurality of chambers sequentially mobile with respect to the breech so as to present one after another in a loading position in which a charging mechanism inserts the cartridge into the breech;

wherein each chamber slides independently on at least one rail set on the magazine longitudinally with respect to a longitudinal axis of the breech;

a cartridge deceleration mechanism, for decelerating said cartridge in the chamber once extracted from the firing chamber.

8. Method for loading and unloading cartridges into/from a magazine for firearms, said firearm comprising a breech or firing chamber wherein the cartridge is made to explode, and a mouth portion for causing the cartridge to pass from the magazine into the breech;

said magazine being engaged to said breech and comprising a plurality of chambers sequentially mobile with respect to the breech to present one after the other in the loading position in which a charging mechanism inserts the cartridge into the breech;

said method comprising the following steps:

a) inserting cartridges into the chambers of the magazine;

b) positioning each chamber with the cartridge loaded in a loading and firing position in correspondence to the breech;

c) loading the cartridge into the breech and firing; and preloading, in which a chamber is brought from a position preceding the loading and firing position of the cartridge into the breech up to a breech block during the loading and firing, wherein during the loading and firing, and during recoil of the breech block subsequent to explosion of a shot, once the block has reached a predetermined recoil distance, a shutter is opened, enabling automatic exit of the cartridge from the breech, and wherein subsequent to automatic exit of the cartridge from the breech, the cartridge is decelerated as the cartridge enters the chamber;

d) unloading the cartridge from the breech block and back into the chamber; and e) unloading the cartridge from the chamber after firing.

* * * * *